US006390461B1

(12) United States Patent
Vitko, Jr. et al.

(10) Patent No.: US 6,390,461 B1
(45) Date of Patent: May 21, 2002

(54) INSERT HOPPER AND METHOD FOR IMPROVING THE OPERATION THEREOF

(75) Inventors: John H. Vitko, Jr., Easton; Richard F. Kanick, Bethlehem, both of PA (US)

(73) Assignee: Bell & Howell Mail & Messaging Technologies Company, Durham, NC (US)

( * ) Notice: Subject to any disclaimer, the term of this patent is extended or adjusted under 35 U.S.C. 154(b) by 0 days.

(21) Appl. No.: 09/527,187

(22) Filed: Mar. 17, 2000

Related U.S. Application Data

(60) Provisional application No. 60/189,301, filed on Mar. 13, 2000.

(51) Int. Cl.[7] ..... B65H 3/08; B65H 3/52; B65H 1/00

(52) U.S. Cl. ..... 271/99; 271/100; 271/123; 271/144

(58) Field of Search ..... 271/144, 23, 99, 271/100, 104, 102, 106, 122, 123, 124, 126, 127

(56) References Cited

U.S. PATENT DOCUMENTS 3,394,930 A * 7/1968 Guggisberg ..... 271/100 X
RE28,048 E * 6/1974 Hageman et al. ..... 271/104
3,861,669 A * 1/1975 Kubo et al. ..... 271/104 X
4,010,944 A * 3/1977 Young ..... 271/144 X
4,013,283 A * 3/1977 Tress et al. ..... 271/100 X
4,369,962 A 1/1983 Spiro
RE32,128 E 4/1986 Blumle
4,630,812 A 12/1986 Yano et al.
4,699,371 A 10/1987 Ettischer et al.
4,986,524 A * 1/1991 Meintzer, Jr. et al. .. 271/100 X
5,014,973 A * 5/1991 Markert et al. ..... 271/100 X
5,050,852 A 9/1991 Sawada et al.
5,062,602 A * 11/1991 Kress et al. ..... 271/104 X
5,330,171 A * 7/1994 Murad et al. ..... 271/131 X
5,927,704 A 7/1999 Quackenbush et al.
5,975,514 A 11/1999 Emigh et al.
6,145,829 A 11/2000 Furmanski et al.

* cited by examiner

*Primary Examiner*—Christopher P. Ellis
*Assistant Examiner*—Gene O. Crawford
(74) *Attorney, Agent, or Firm*—Jenkins & Wilson, P.A.

(57) ABSTRACT

An improved insert hopper for use in conjunction with the insert feeding device of a document handling apparatus such as a mail insertion machine. The insert hopper includes a support deck, a front registration member, and a backstop member. A bottom support plate for the insert hopper has an outer surface constructed of a low-friction material such as PTFE, chrome, or finished stainless steel. One or more wedge blocks are mounted on the support deck. Each wedge block has an insert support surface supporting a trailing edge of the lowermost insert of an insert stack loaded in the insert hopper. The insert hopper can optionally have a tilted orientation with respect to the vertical.

68 Claims, 10 Drawing Sheets

INSERT HOPPER AND METHOD FOR IMPROVING THE OPERATION THEREOF

RELATED APPLICATION INFORMATION

This application claims the benefit of U.S. Provisional Patent Application No. 60/189,301 entitled, "Improved Insert Hopper and Method for Improving the Operation Thereof", filed Mar. 13, 2000, the disclosure of which is incorporated herein by reference in its entirety.

TECHNICAL FIELD

The present invention is generally directed to an apparatus for feeding insert materials from one or more insert storage devices to an insert processing machine such as a mail processing machine. More particularly, the present invention is directed to an insert hopper having components which improve the operation of the insert hopper.

BACKGROUND ART

Mail insertion machines automate many mail processing tasks. These tasks include handling documents, invoices, cards and other types of inserts, inserting a single insert or group of inserts into envelopes, sealing the envelopes, and accumulating the resulting mail packages. A key component of the mail insertion machine is the insert hopper or magazine, which is used typically to store inserts and prepare the inserts for extraction or feeding into other stations of the mail insertion machine.

One type of insert feed station that can be used in a mail insertion machine is illustrated in FIG. 1. An example of this insert feed station, generally designated 10, is disclosed in U.S. Pat. No. 4,369,962 to Spiro. Insert feed station 10 includes an insert hopper generally designated 15 and an insert extraction means generally designated 20. Insert hopper 15 includes a front guide plate 15A, a rear guide wall or back stop 15B, and a bottom support 15C. Front guide plate 15A, back stop 15B and bottom support 15C cooperate to generally define an insert hopper area 15' in which a stack of inserts 25 can be loaded. Insert hopper 15 has a bottom opening 15D defined between bottom support 15C and front guide plate 15A through which the lowermost insert of insert stack 25 can be extracted from insert hopper 15. In mail insertion machines adapted to process a plurality of different inserts, several insert feed stations 10 with associated insert hoppers 15 and insert extraction means 20 can be disposed in series along the course of the mail insertion machine.

One or more air nozzles such as air nozzle 32 communicating with a compressed air source (not shown) are mounted to front guide plate 15A. Air is blown through air nozzle 32 between the lowermost sheet and next-to-lowermost inserts of insert stack 25, thereby "fluffing" these inserts to ensure that an insert hopper suction cup 34 (or a plurality thereof) disposed below insert hopper 15 engages and separates only the lowermost insert. Suction cup 34 is attached to vacuum tubing 36 through which vacuum is provided from a vacuum source (not shown). Suction cup 34 is mounted at the end of a reciprocating arm 38 pivotably mounted to a shaft 39.

Insert extraction means 20 includes an arcuate vacuum surface 42 generally disposed below suction cup 34 and attached to a reciprocating arm 44 pivotably mounted to a shaft 45. Vacuum surface 42 includes a plurality of orifices 42A communicating with a plenum chamber 42B (shown in phantom) and ultimately with a vacuum source (not shown). After rotating upwardly and engaging the lowermost insert, suction cup 34 retracts downwardly to separate the lowermost insert from insert stack 25. Vacuum surface 42 then engages the lowermost insert and rotates about shaft 45 to bring the lowermost insert into engagement with the remaining portions of insert extraction means 20.

The remaining portions of insert extraction means 20 include a pair of oppositely rotating nip rollers 46A and 46B, each of which are driven by respective belts or chains 47A and 47B and pulleys or sprockets 48A and 48B, and an actuating roller 52. Actuating roller 52 is pivotably mounted to the end of a rocker arm 54. Rocker arm 54 itself is pivotably mounted to a reciprocating arm 56 which moves synchronously with respect to vacuum surface 42. The rocking motion of rocker arm 54 is effected through a rotating cam 58 and a reciprocating cam follower 58A. At the urging of cam 58, cam follower 58A translates downwardly through the bore of an extension member 56A of reciprocating arm 56, thereby lifting actuating roller 52, and retracts with the biasing assistance of a spring 58B. Actuating roller 52 can be used to urge the lowermost insert against vacuum surface 42 and/or between nip rollers 46A and 46B. Nip rollers 46A and 46B drive the lowermost sheet toward the next station of the mail insertion machine. The next station can be another insert feed station 10 for feeding a different type of insert, an envelope stuffing station, or the like.

Another type of insert feed station is illustrated in FIG. 2. An example of this insert feed station, generally designated 100, is disclosed in U.S. Pat. No. 5,975,514 to Emigh et al. Insert feed station 100 includes insert hopper generally designated 15 and an insert extraction means generally designated 120. As in the prior example, insert hopper 15 includes front guide plate 15A, back stop 15B, bottom support 15C, insert hopper area 15' and bottom opening 15D between bottom support 15C and front guide plate 15A through which the lowermost insert of insert stack 25 can be extracted from insert hopper 15. Suction cup 34 is also provided. In this case, a pneumatically driven cylinder 135 and mechanical linkages 135A are used to reciprocate suction cup 34 through its positions. In FIG. 2, however, the approaches taken for insert separation and extraction are different.

Insert feed apparatus 100 in FIG. 2 includes an insert separator foot 132 that is reciprocated by linkage 133A and pneumatically driven cylinder 133. A tip 132A of insert separator foot 132 rotates toward insert hopper 15 and into a position between the trailing edges of the lowermost insert and next-to-lowermost insert. Tip 132A ensures that only the lowermost insert is engaged and separated by suction cup 34. Insert extraction means 120 is characterized by a gripper jaw assembly 146 attached at the end of a picker arm 148. Picker arm 148 rotates in reciprocating fashion about a drive shaft 149 journaled in a bearing 152 at the end of an angled arm 154. Gripper jaw assembly 146 includes a stationary foot 146A and a movable gripper jaw 146B. Gripper jaw 146B is actuated by a pneumatically driven cylinder 155 interposed between pivotal attachments 155A and 155B mounted to picker arm 148 and gripper jaw 146B, respectively. Gripper jaw assembly 146 thus operates in synchronous cycles with suction cup 34 and insert separator foot 132 to extract the lowermost insert from insert stack 25.

FIG. 2 also illustrates an insert track conveyor 160 on which a group of inserts or an extracted insert such as insert I travel to downstream stations of the mail insertion machine. Insert track conveyor 160 is driven by a drive chain 160A, and insert I is guided by pusher fingers or flights 160B extending upwardly from drive chain 160A. An insert track hold-down foot 165 (or a plurality thereof) can be used to secure inserts I in proper positions on insert track conveyor 160 during successive track advancements. In the example shown, insert track hold-down foot 165 is pivotably mounted on a shaft 166 and actuated through a linkage 167A and pneumatically driven cylinder 167.

Insert feed apparatuses such as station 10 shown in FIG. 1 and station 100 shown in FIG. 2 generally perform well for their intended purposes within the context of mail insertion machines. Current insert hopper designs, however, present some limitations that affect the overall utility of insert feed apparatuses and their associated mail insertion machines.

One limitation relates to the working stack height of insert stack 25 loaded into insert hopper 15, i.e., the maximum number of inserts that can be loaded into insert hopper 15 without impairing the operation of the particular insert extraction means used. For any given insert feed apparatus, the working stack height depends upon the type of insert, the finish provided on the surface of the insert, the size of the insert, and the weight of the insert. End users of mail insertion machines often find that the working stack height of insert hoppers 15 provided with the machines is less than the height, or capacity, suggested by the physical attributes of insert hoppers 15. For example, insert hopper 15 might initially be observed as large enough to hold 100 inserts of a given type, but in practice could hold a maximum of only 50 inserts of that type to ensure error-free operation.

The chief limiting factor for the working stack height is the magnitude of the gripping force or effort required to extract the lowermost insert from the bottom of insert stack 25. This extraction force is dictated largely by the coefficient of friction between the lowermost insert and bottom support 15C, and by the downward force vector resulting from the cumulative weight of insert stack 25. A maximum working stack height for a given type of insert can be empirically indicated at the point where the insert extraction means begins to "miss" or fail to pull inserts away from insert hopper 15. A maximum height can also be indicated at the point where the insert extraction means engages the inserts successfully but the requisite extraction force begins to exceed the tensile strength of the insert material, with the result that the engaged or gripped portion of the inserts are torn away. Such feeding errors interfere with the smooth, synchronized process flow of mail insertion machines, limit the operating times of insert feed apparatuses, and in turn increase the time required to process a given mail handling job.

A second limitation relates to the registration of the lowermost insert against one or more of the boundaries of insert hopper 15, especially against front guide plate 15A. The lowermost insert must be properly registered in order to bring it into alignment with the gripping means during the extraction procedure and thereby prevent misfeeds and other errors. Improper registration of insert stack 25 is an ongoing problem in current insert hopper designs. The problem is particularly acute with the lowermost insert. The lowermost insert is often misaligned with respect to the remaining portion of insert stack 25. Moreover, if the lowermost insert had been improperly sheared during some upstream cutting process, a portion of the next-to-lowermost insert of insert stack 25 can be exposed to suction cup 34. This can result in the well-known "double-insert" type of misfeed. Hence, in current insert hopper designs, improper registration of the lowermost insert is frequently a random, uncontrolled event.

A third limitation relates to the existence of warped inserts loaded into insert hopper 15. Warped inserts are difficult to register within insert hoppers 15 and thus difficult to feed without ensuing errors.

Measures taken heretofore to address the limitations of current insert hopper designs have enjoyed limited success. One approach has been to tilt or mount insert hopper 15 at an incline (e.g., 8°–10° from the vertical) in order to reduce the vertical component of the downward force vector imposed by the weight of insert stack 25. This approach by itself has generally been considered to be inadequate by those skilled in the art. Another approach recognizes that an "optimum break point" can be found for the lowermost insert of insert stack 25. The optimum break point is generally defined as the point at which the lowermost insert bends in response to the application of vacuum by suction cup 34 to align the lowermost insert for extraction by the insert extraction means. The optimum break point can be adjusted by making the position of bottom support 15C adjustable in the insert feed direction, which accordingly renders the area of insert hopper bottom opening 15D adjustable. Because of the afore-mentioned problems with friction of bottom support 15C and registration of the lowermost insert within insert hopper 15, the ability to adjust bottom support 15C in current designs is frequently ineffective to prevent misfeeds. Such misfeeds occur even when the working stack height is reduced, and thus the provision of adjustable bottom supports 15C has not improved the loading capacity of current insert hoppers 15. Moreover, the discovery of an optimum break point for insert stack 25 cannot address the problems associated with warped inserts located randomly within insert stack 25.

An increase in the working stack height would permit a greater number of inserts to be loaded into insert hopper 15, and consequently permit an insert feed apparatus to feed inserts over a longer period of time before a reloading or refilling of insert hopper 15 is required. This, in turn, would result in a reduction in the down-time occasioned by the reloading of insert hopper 15 and a concomitant increase in the overall efficiency of the mail insertion machine. Furthermore, improvements in registration of the lowermost insert as well as entire insert stack 25 would result in a more successful prevention of misfeeds, even in the case of warped inserts.

The present invention is provided to address these and other problems associated with insert hoppers such as those depicted in FIGS. 1 and 2, as well as other devices used in the bottom-feeding of inserts or documents from stacks employed in conjunction with insert or document handling apparatuses.

DISCLOSURE OF THE INVENTION

Accordingly, the present invention includes two primary solutions for improving insert hoppers. The first is the provision of a bottom support having a reduced-friction outer surface. The second is the provision of wedges disposed at a trailing edge of an insert stack loaded into the insert hopper and supported by the bottom support. The reduced-friction bottom support and wedges can be used in conjunction with common types of tilted or untilted insert hoppers in a variety of insert handling applications. The novel bottom support and wedges operate to reduce the coefficient of friction between the bottom support and the lowermost insert of the insert stack. This in turn reduces the magnitude of force or effort required by extraction means provided with the insert hopper to extract inserts from the insert stack and feed the inserts to downstream operations. The wedges reduce the area of contact between the lowermost insert and bottom support, and urge the lowermost insert into proper registration with a front guide plate of the insert hopper to ensure proper alignment with the extraction means. The wedges also force or shape a warped insert into a corrected profile sufficient to permit error-free extraction from the insert hopper. The reduced-friction bottom support and wedges additionally increase the effectiveness of adjustment means utilized to support the optimum break point of inserts, as well as the effectiveness of tilted insert hoppers. As a result, an improved insert hopper is provided with either the reduced-friction bottom support, the wedges, or both, and can accommodate an insert stack height four to five times larger than that of conventional insert hoppers.

In one embodiment according to the present invention, an insert hopper is provided for storing a stack of inserts and enabling seriatim extraction of the lowermost insert of the insert stack from a lower location of the insert stack along an insert feed direction. A support deck defines a lower boundary of an insert hopper area in which the insert stack can be loaded. A front registration member extends upwardly in relation to the support deck and defines a front boundary of the insert hopper area. The front registration member registers respective leading edges of the insert stack loaded in the insert hopper area. A backstop member extends upwardly in relation to the support deck and defines a rear boundary of the insert hopper area. The backstop member is spaced rearwardly with respect to the front registration member along the insert feed direction, which is defined as a general direction from the backstop member toward the front registration member.

The insert hopper further comprises a bottom support plate having a front edge and mounted on the support deck. The bottom support plate has an outer surface on which a lowermost insert of the insert stack is disposed. The outer surface is constructed of a low-friction material such as PTFE, chrome, or finished stainless steel. The front edge of the bottom support plate and the front registration member cooperatively define in insert hopper bottom opening through which the lowermost insert can be extracted in the insert feed direction.

In a further embodiment according to the present invention, the outer surface of the bottom support plate is constructed of a low-friction material which exhibits a coefficient of friction less than a coefficient of friction exhibited by a conventional material such as a cold-rolled steel plate.

In another embodiment according to the present invention, an insert hopper is provided for storing a stack of inserts and enabling seriatim extraction of the lowermost insert of the insert stack from a lower location of the insert hopper along an insert feed direction. A support deck is disposed in a plane and defines a lower boundary of an insert hopper area in which the insert stack can be loaded. A front registration member extends upwardly in relation to the support deck and defines a front boundary of the insert hopper area, and further defines an insert hopper bottom opening through which the lowermost insert of the insert stack can be extracted. A backstop member extends upwardly in relation to the support deck and defines a rear boundary of the insert hopper area. The backstop member is spaced rearwardly with respect to the front registration member along the insert feed direction. A wedge block is mounted on the support deck and has an insert support surface. The insert support surface supports a trailing edge of the lowermost insert and extends into the insert hopper area. The insert support surface is angled with respect to the plane.

In yet another embodiment according to the present invention, a mail insertion machine is provided. The mail insertion machine comprises an insert hopper and an insert extraction device. The insert extraction device is adapted to cyclically move into engagement with a lowermost insert of an insert stack loaded in the insert hopper, and to extract the lowermost insert from the insert hopper. The insert hopper includes a bottom support plate having an outer surface constructed of a low-friction material as described hereinabove.

In a further embodiment according to the present invention, a mail insertion machine is provided and comprises an insert hopper and an insert extraction device. The insert hopper includes a wedge block as described hereinabove.

The present invention additionally provides a method for increasing the capacity of an insert hopper to hold and register a stack of inserts loaded into the insert hopper for subsequent improved extraction from the insert hopper. The insert hopper is constructed by providing a support deck, a front registration member and a backstop member. A bottom support plate is also provided. The bottom support plate has an outer surface on which a lowermost insert of the insert stack is disposed. A front edge of the bottom support plate cooperates with the front registration member to define an insert hopper bottom opening through which the lowermost insert can be extracted from the insert hopper in an insert feed direction. The friction of the bottom support plate is reduced by providing a low-friction material for the outer surface. The low-friction outer surface is constructed of PTFE, chrome, or finished stainless steel.

In another method for improving an insert hopper according to the present invention, the insert hopper is constructed by providing a support deck, a front registration member, and a backstop member. A wedge block is provided, and has an insert support surface angled with respect to the plane. The wedge block is mounted on the support deck, whereby the insert support surface extends into an insert hopper area of the insert hopper to support a trailing edge of a lowermost insert of an insert stack loaded into the insert hopper.

It is therefore an object of the present invention to provide an insert hopper capable of operating with an increased working stack height without impairing the operation of an associated insert extraction device.

It is another object of the present invention to provide an insert hopper in which the lowermost insert of an insert stack loaded into the insert hopper is consistently and properly registered within the insert hopper, such that the lowermost insert is aligned with an insert extraction device and misfeeds are prevented.

It is yet another object of the present invention to reduce the coefficient of friction between the bottom support plate of an insert hopper and the lowermost insert of an insert stack loaded in the insert hopper.

It is a further object of the present invention to provide an improved insert hopper wherein a greater number of inserts to be loaded therein, and inserts can be fed from the insert hopper over a longer period of time before the insert hopper must be reloaded.

Some of the objects of the invention having been stated hereinabove, and which are achieved in whole or in part by the present invention, other objects will become evident as the description proceeds when taken in connection with the accompanying drawings as best described hereinbelow.

DETAILED DESCRIPTION OF THE INVENTION

Figure 1:
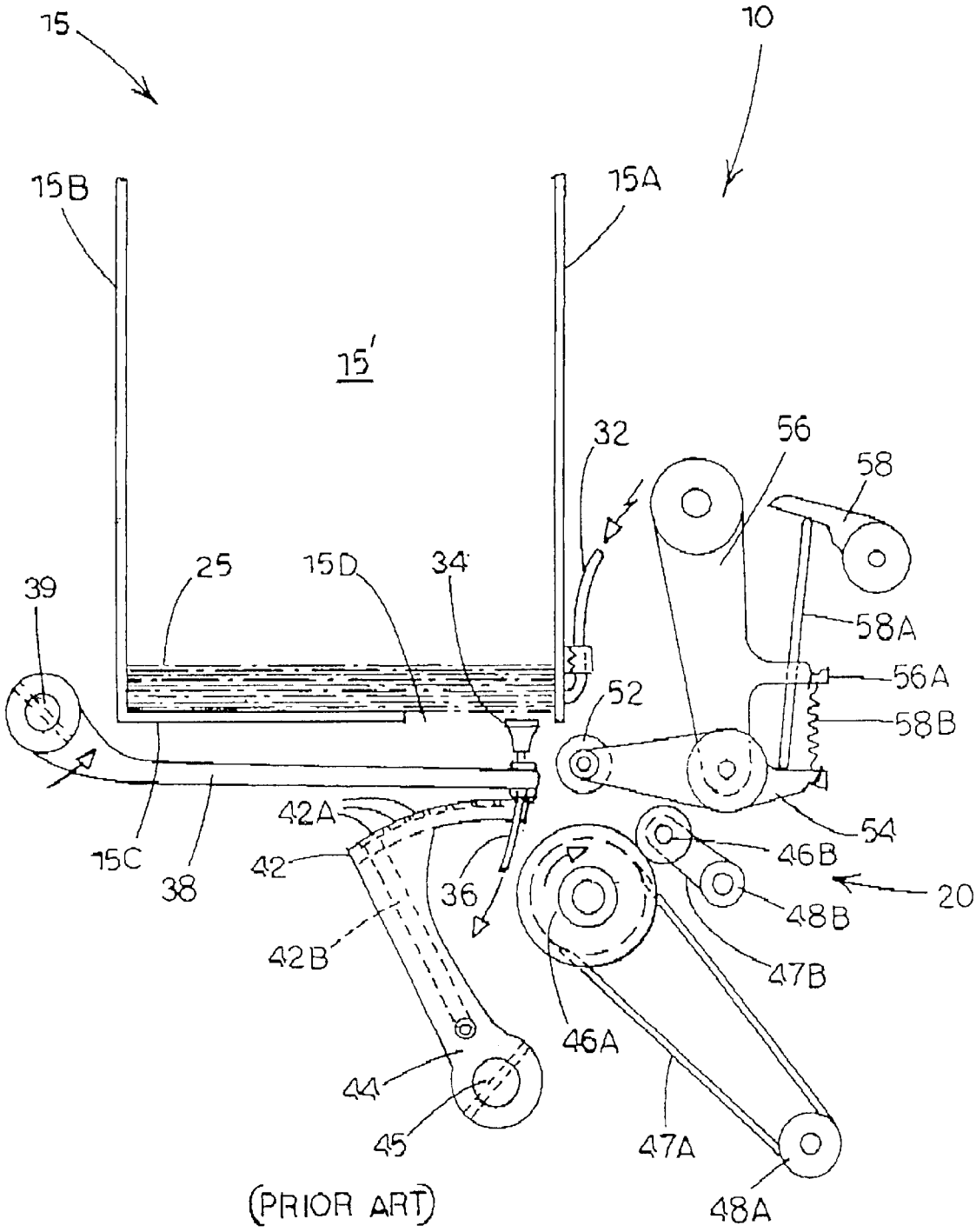
(PRIOR ART) Fig. 1
FIG. 1 is a side elevation view of a prior art insert feed station which can be used in connection with an insert hopper designed in accordance with the present invention.

Referring to FIGS. 3–6, a portion of an inserting station generally designated 200 is provided in accordance with the present invention. Inserting station 200 typically forms a part of a mail inserting machine (not shown). An inserting station support deck 202 is typically provided at a rear section of the mail insertion machine. Inserting station 200 includes an insert hopper generally designated 215. Insert hopper 215 is generally bounded by support deck 202, a pair of bottom guide tabs 217A and 217B extending from support deck 202 in an insert feed direction generally indicated by arrow A, a back stop 220 slidably mounted on an upper surface 202A of support deck 202, a front guide plate 222 mounted to a non-illustrated section of the mail insertion machine, and side plates 224A and 224B mounted to front guide plate 222. Insert hopper 215 is adapted to contain an insert stack 225. It can be seen that a plurality of insert feed stations 200 with corresponding insert hoppers 215 can be mounted along the course of support deck 202. A single, common front guide plate 222 can be provided for all such insert feed stations 200.

Figure 6:
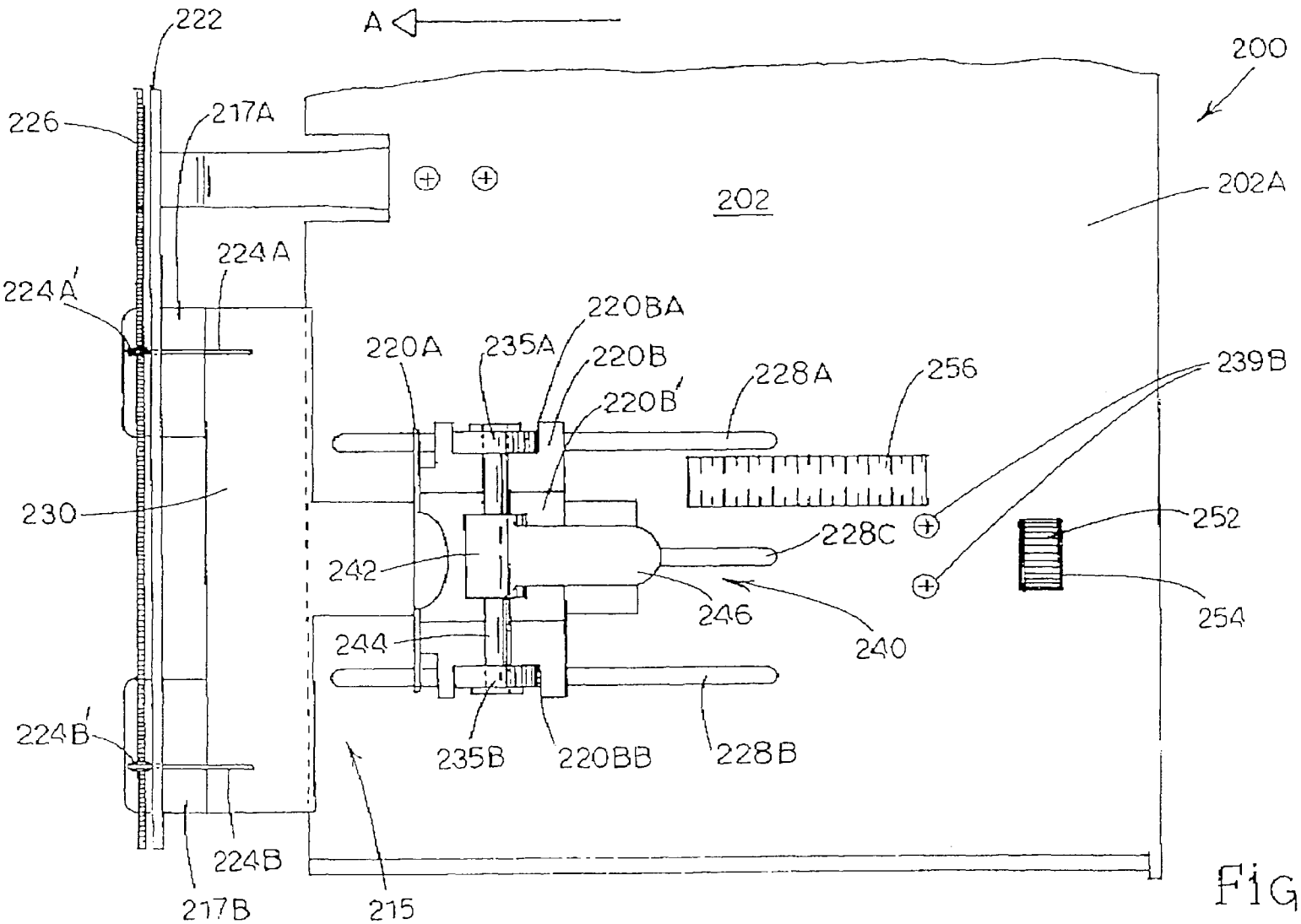
FIG. 6 is a top plan view of the insert hopper of FIG. 3.
Figure 8:
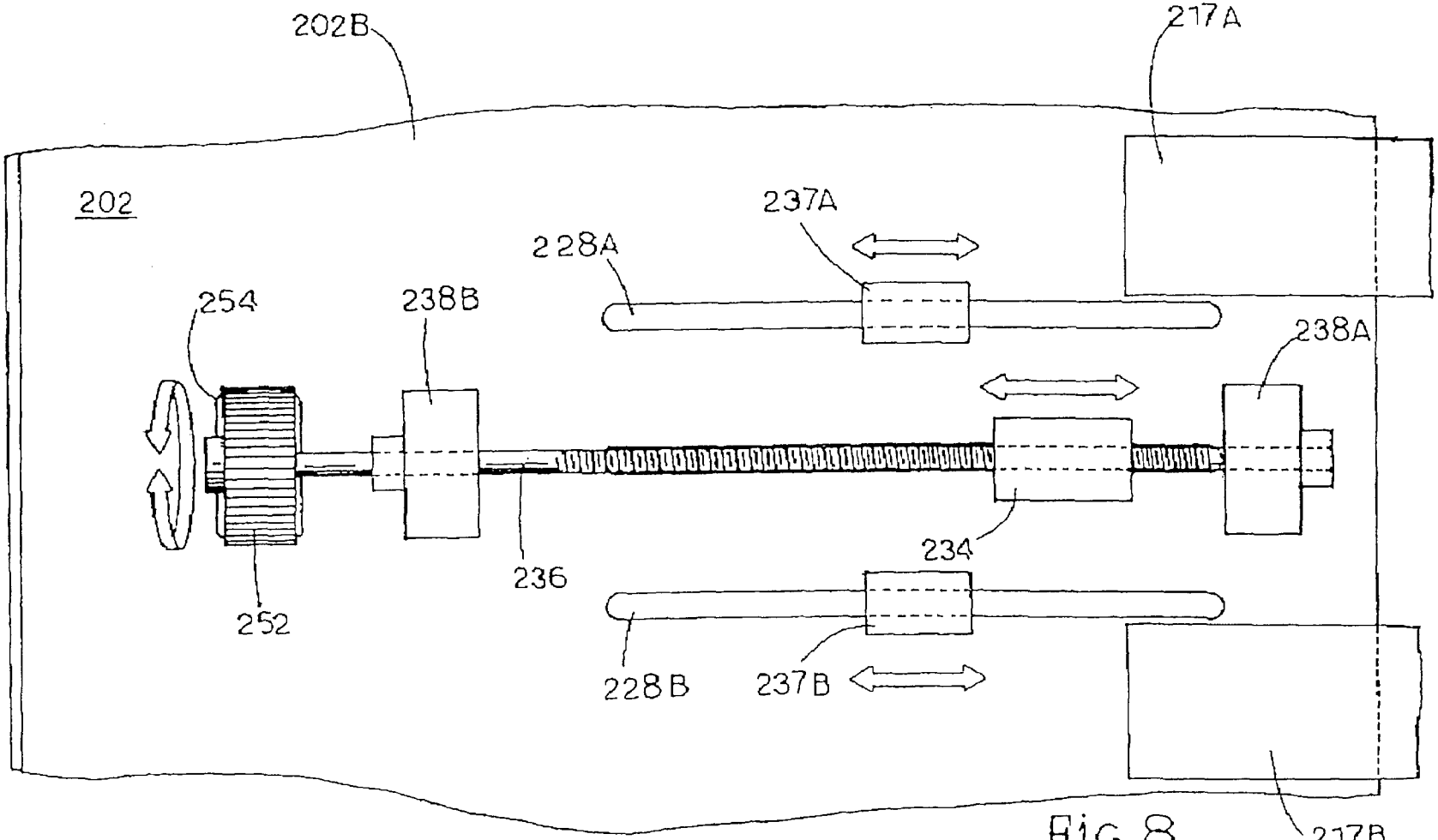
FIG. 8 is a bottom plan view of the insert hopper of FIG. 3.

As shown in FIG. 8, bottom guide tabs 217A and 217B can extend underneath support deck 202 in contact with a bottom surface 202B thereof. Bottom guide tabs 217A and 217B can thus be secured to bottom surface 202B such as by welding. As shown in FIG. 6, a lower portion 224A', 224B' of each side plate 224A, 224B can extend underneath front guide plate 222 to engage a toothed or notched rail 226. This permits adjustment of side plates 224A and 224B to accommodate different sizes of insert stacks 225.

Referring now to FIGS. 3, 4, 6 and 8, each inserting station 200 includes a group of three slots 228A, 228B, 228C formed in support deck 202. A vertical section 220A of back stop 220 includes two lower protrusions 220A' and 220A", best illustrated in FIG. 3, which extend respectively in lateral slots 228A and 228B to enable back stop 220 to be slidably adjusted along insert feed direction A and thereby accommodate different sizes of insert stacks 225. Vertical section 220A has a boss 220AA formed on the side of back stop 220 opposite insert stack 225. Back stop 220 further includes a horizontally disposed base plate 220B welded to vertical section 220A, such that back stop 220 is L-shaped. Base plate 220B includes a raised section 220B' to accommodate insertion of a bottom support 230 between base plate 220B and support deck 202.

A pair of radius members 235A and 235B are disposed on either side of back stop 220 and are confined within notches 220BA and 220BB of base plate 220B of back stop 220. As shown in FIG. 8, each respective radius member 235A, 235B extends through lateral slot 228A, 228B and includes a lateral slide block 237A, 237B disposed underneath support deck 202. Radius members 235A, 235B thus slide along the respective lengths of lateral slots 228A and 228B to assist in adjusting the position of back stop 220 on support deck 202, and also maintain back stop 220 in proper alignment with front guide plate 222.

A cam-lock mechanism generally designated 240 is used to lock back stop 220 in place along the lengths of lateral slot 228A, 228B. Cam-lock mechanism 240 includes a partially arcuate cam 242 centrally supported and rotatable about shaft 244. Shaft 244 extends through shaft support bores drilled through radius members 235A and 235B on either side of cam 242. A handle 246 connected to cam 242 permits manual rotation of cam 242 about shaft 244. Downward manipulation of handle 246 forces the partially arcuate outer surface of cam 242 into engagement with boss 220AA of vertical section 220A of back stop 220 as well as with raised section 220B' of base plate 220B. This cam action causes a slight bending of shaft 242, resulting in reactive forces which urge lateral slide blocks 237A and 237B of radius members 235A and 235B into frictional contact with lower surface 202B of support deck 202.

Figure 7:
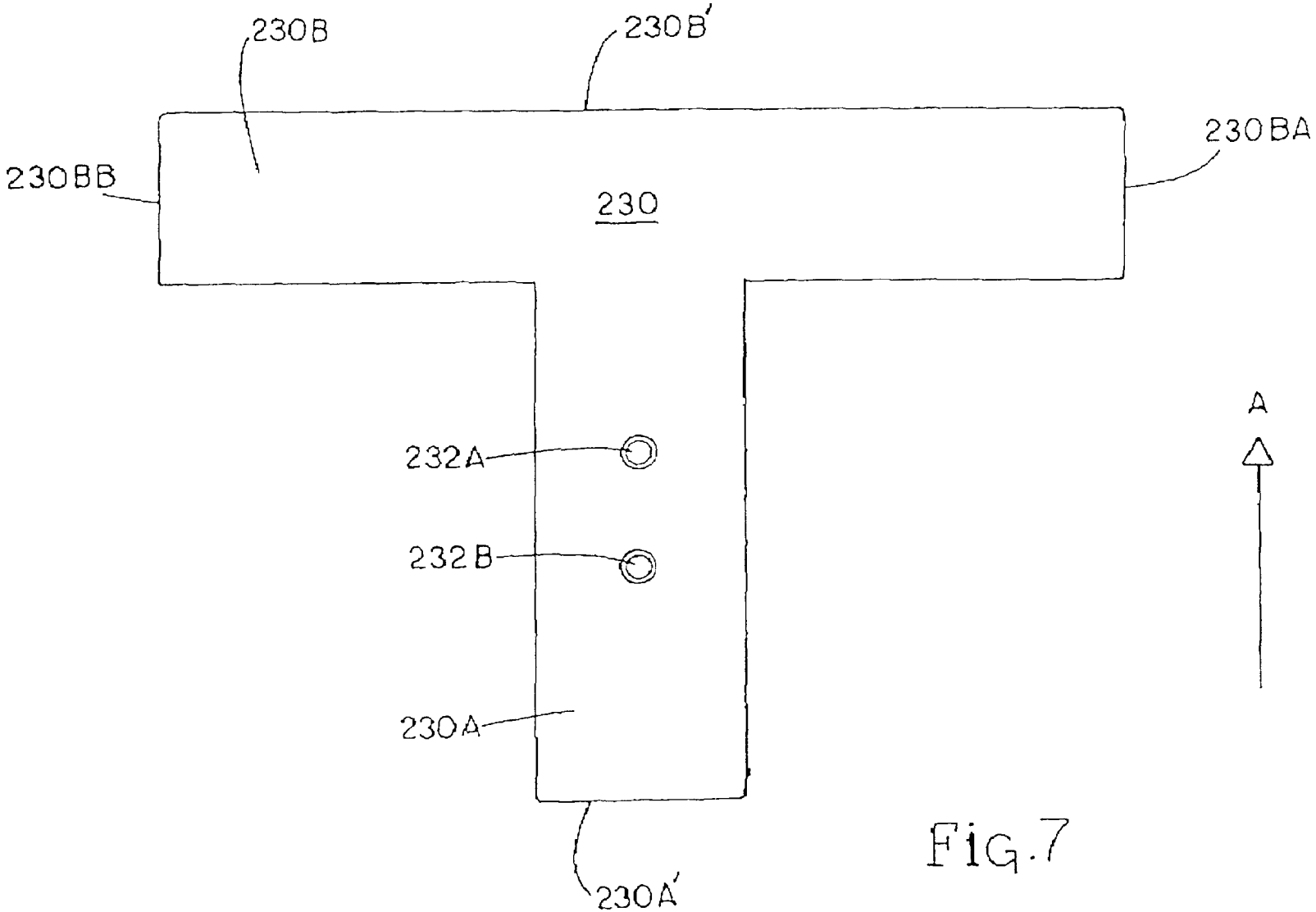
FIG. 7 is a top plan view of a bottom support plate in accordance with the present invention.

In accordance with the present invention, bottom support 230 and a pair of wedge blocks 260A and 260B are provided. Referring to the preferred embodiment shown in FIG. 7, bottom support 230 is preferably T-shaped although other shapes can be provided. Bottom support 230 (referenced hereinafter as "T-plate") thus includes a longitudinal section 230A extending along insert feed direction A and a transverse section 230B perpendicular to longitudinal section 230A. In one example, transverse section 230B has a width of 8 inches between its lateral edges 230BA and 230BB and a length of 1.5 inches, longitudinal section 230A has a width of 1.75 inches, and the length in insert feed direction A from a rear edge 230A' of longitudinal section 230A to a front edge 230B' of transverse section 230B is 6 inches. T-plate 230 is preferably adjustable along insert feed direction A, and for this purpose has two mounting holes 232A and 232B drilled therethrough.

The outer surface of T-plate 230 is constructed of a low-friction material. For this purpose, T-plate 230 is preferably constructed of aluminum and coated with PTFE (polytetrafluouroethylene). Suitable material from which to form T-plate 230 is available from TITANIUM FINISHING and specified as having TEFLON® impregnated hard coat with a thickness of 0.002±0.0005 inches. The outer surface could also constitute hard chrome plating. As an alternative to providing an outer coating or plating, the friction of T-plate 230 could be reduced by a finishing process such as grain orientation, polishing or diamond "plating" of stainless steel. It will be understood that the terms "low-friction" and "reduced friction", as used herein, generally refer to the result of coating, plating and finishing as described hereinabove, as well as any other equivalent step taken in order to reduce the friction of a conventional insert hopper bottom support. An example of a conventional insert hopper bottom support is a plate constructed of AISI C1010 16-gauge cold-rolled steel, which can be treated with a black oxide coating. T-plate 230 constructed in accordance with the present invention exhibits much lower friction than a conventional plate coated with black oxide.

Referring to FIG. 8, means for adjusting T-plate 230 are disposed beneath bottom surface 202B of support deck 202.

Figure 3:
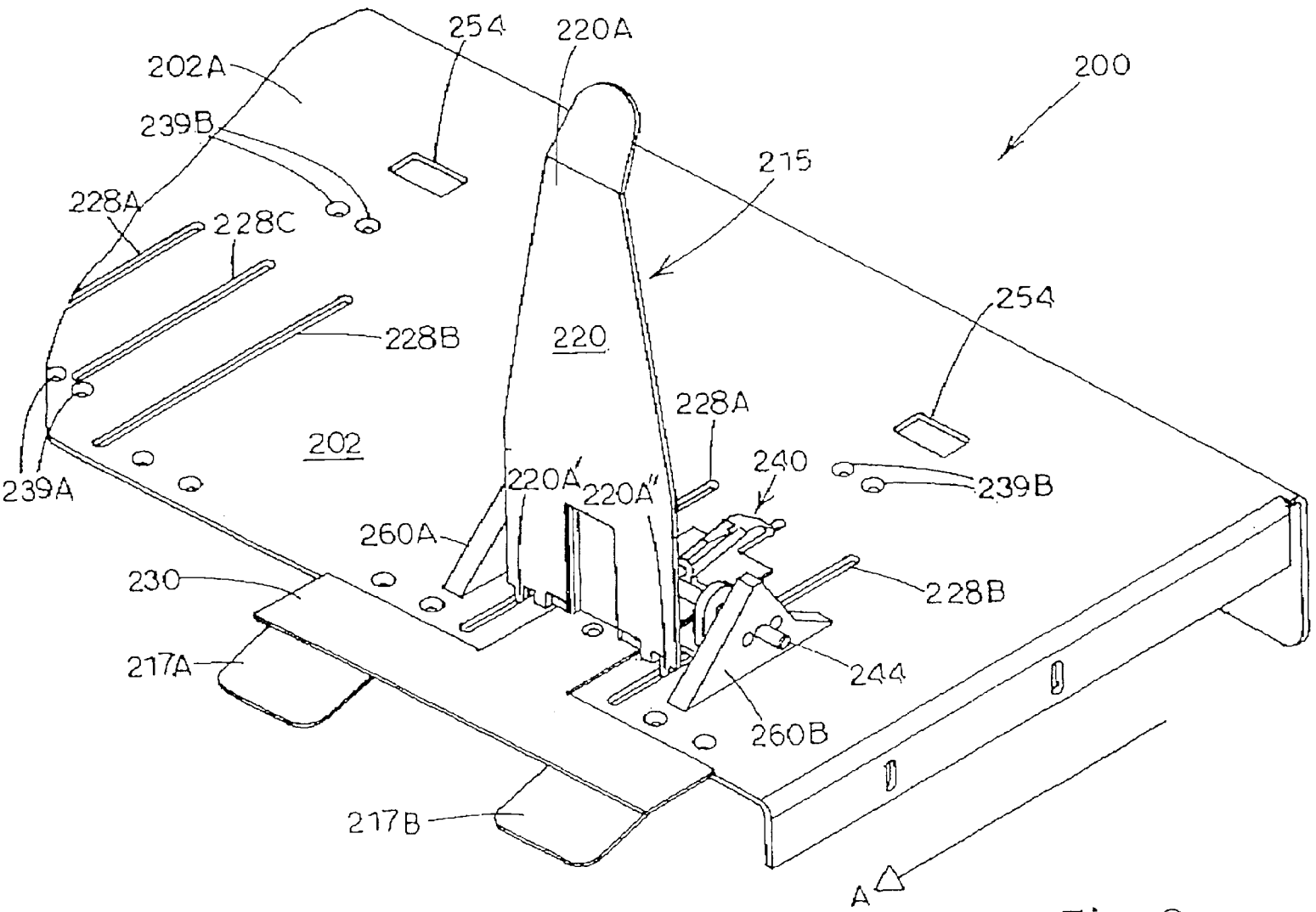
FIG. 3 is a perspective view of a portion of an insert hopper designed in accordance with the present invention.
Figure 4:
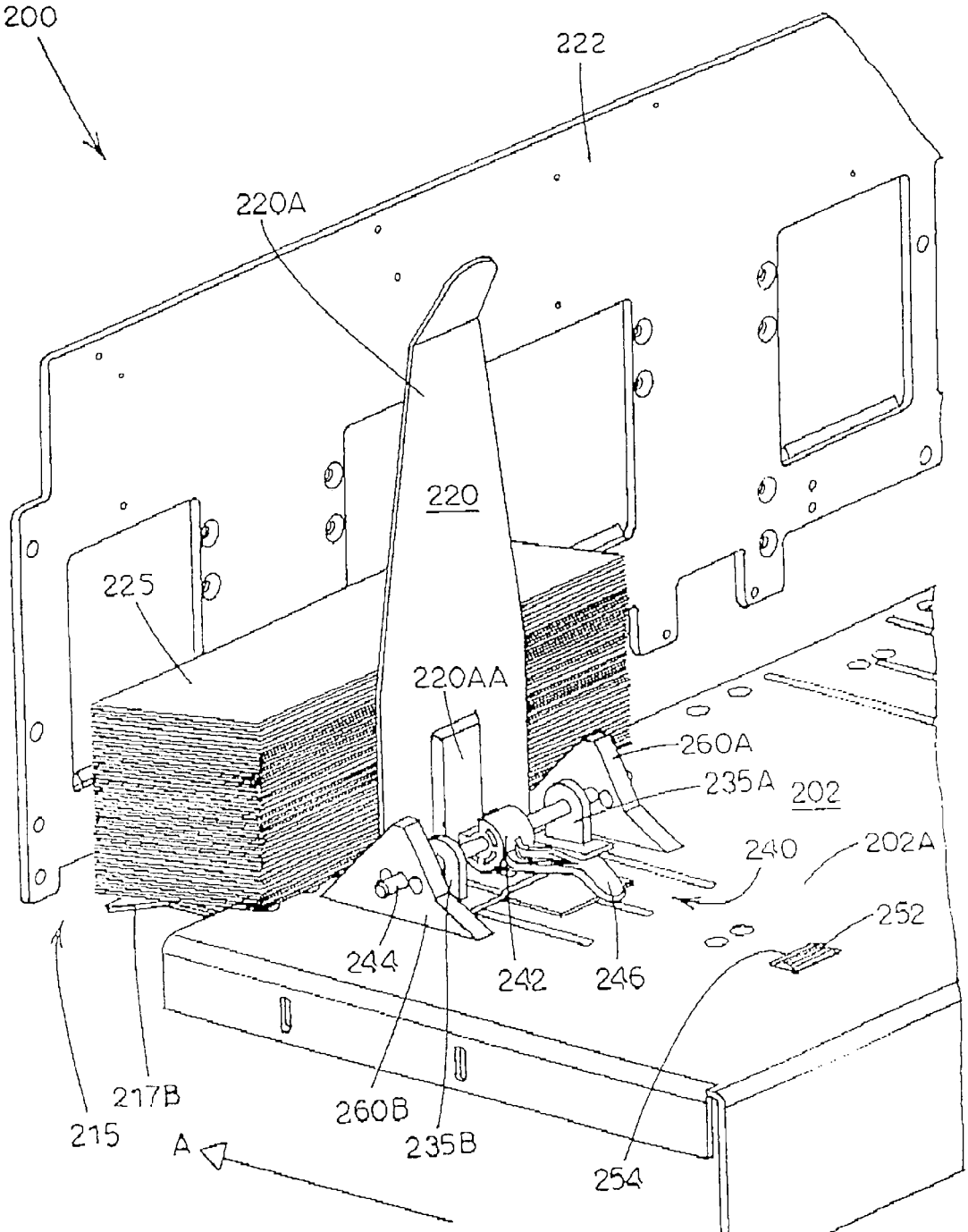
FIG. 4 is another perspective view of the insert hopper of FIG. 3.

Mounting holes 232A and 232B of T-plate 230 are used to fasten T-plate 230 to a central slide block 234 movable along the length of central slot 228C. Central slide block 234 is driven by a lead screw 236 rotatably supported in front and rear pillow block bearings 238A and 238B, respectively. Note that lead screw 236 conceals central slot 228C in FIG. 8. Front and rear pillow block bearings 238A and 238B are respectively secured to bottom surface 202B of support deck 202 at front and rear mounting holes 239A and 239B on support deck 202 (see FIG. 3). A knurled adjustment knob 252 secured to the free end of lead screw 236 enables manual adjustment of T-plate 230. As shown in FIGS. 4, 6, and 8, adjustment knob 252 partially protrudes through a hole 254 of support deck 202 to facilitate manipulation of adjustment knob 252. As shown in FIG. 6, an indicator strip 256 with hash marks printed thereon is adhered to upper surface 202A of support deck 202 for precision adjustment of T-plate 230.

Figure 9:
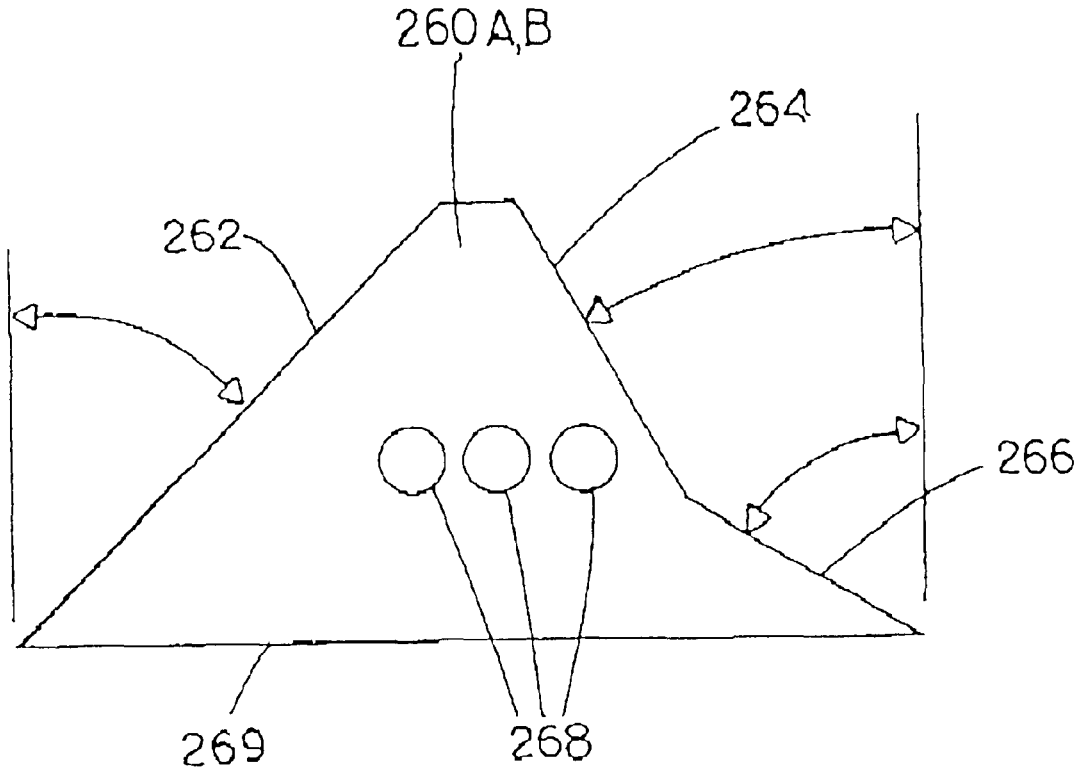
FIG. 9 is a side elevation view of a wedge block designed in accordance with the present invention.
Figure 10:
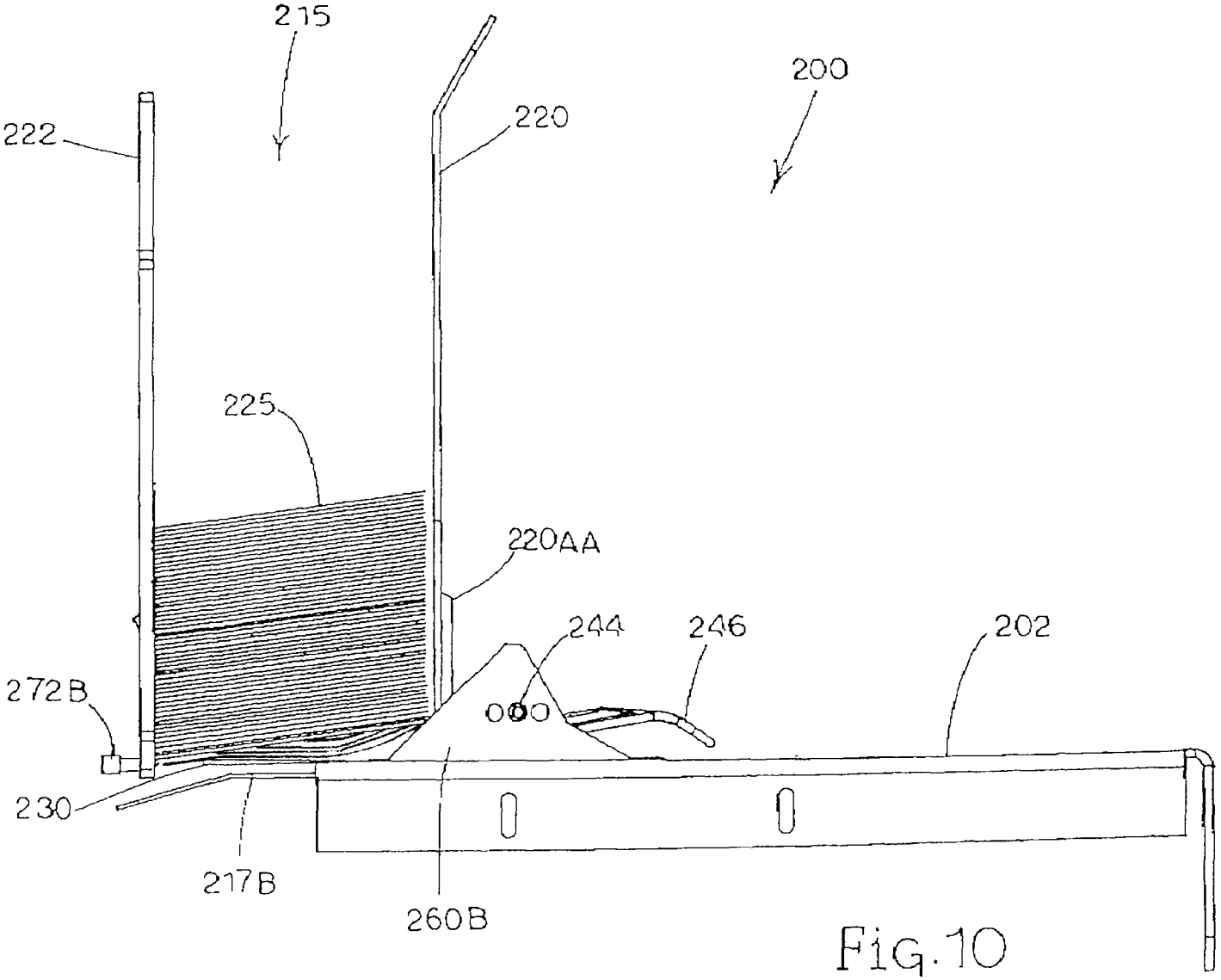
FIG. 10 is a side elevation view of the insert hopper of FIG. 3.

Referring to the preferred embodiment shown in FIG. 9, wedge block 260B is illustrated with the understanding that wedge block 260A is a mirror image thereof. Each wedge block 260A, 260B has a plurality of angled surfaces which can be used to engage and support the lowermost insert of insert stack 225. For example, wedge blocks 260A and 260B can each include a first surface 262 angled at 45° with respect to the vertical, a second surface 264 angled at 30°, and a third surface 266 angled at 60°. Stated differently, second surface 264 can be considered to be angled at 60° from the horizontal and third surface 266 can be considered to be angled at 30° from the horizontal. Wedge block 260A, 260B also has one or more bores 268 drilled laterally therethrough. In this example, a base 269 of each wedge block 260A and 260B has a length of 3.27 inches and a thickness of 0.38 inch, and bores 268 have a diameter of 0.249±0.005 inch. Wedge blocks 260A, 260B are preferably constructed of DELRIN polymeric material, although other types of polymeric material or metals could be used. As shown in FIGS. 3, 4, and 10, wedge blocks 260A and 260B are slidably disposed on upper surface 202A of support deck 202 on either side of back stop 220. For purposes of clarity, wedge blocks 260A and 260B are not shown in the top view of FIG. 6. Preferably, shaft 244 of cam-lock mechanism 240 extends through one of bores 268 of each wedge block 260A, 260B, such that each wedge block 260A, 260B adjustably slides on support deck 202 in unison with back stop 220. Shaft 244 and bores 268 can be sized to produce a slight press fit of shaft 244 within bores 268 and thus reduce vibration of wedge blocks 260A and 260B on support deck 202 during machine operations.

Wedge blocks 260A and 260B can be configured in a variety of ways to optimize insert hopper 215 for a given mail processing job and type of insert. In each configuration, one surface of each wedge block 260A, 260B is selected to be the surface used to support the trailing edge of the lowermost sheet of insert stack 225, and that surface necessarily will extend into the insert hopper area. In FIGS. 3, 4, and 10, for example, 45° surface 262 is selected to be the contact surface. The degree to which 45° surface 262 extends into the insert hopper area can be adjusted by selecting the particular bore 268 of each wedge block 260A, 260B through which shaft 244 of cam-lock mechanism 240 extends. This adjustment will consequently affect the degree to which wedge blocks 260A and 260B urge insert stack 225 into registration against front guide plate 222, as well as the degree to which the frictional contact area between the lowermost insert and T-plate 230 is reduced. In addition, each wedge block 260A, 260B can be turned around such that the lowermost insert encounters either 30° surface 264 or 60° surface 266. In this latter configuration, the particular bore 268 through which shaft 244 extends will also determine which of 30° or 60° surfaces 264 or 266 becomes the operative surface.

In one exemplary application of wedge blocks 260A and 260B, inserts constructed of thin, glossy material are considered to be best supported by 30° surface 264. This lower wedge angle ensures that thin, glossy inserts are not registered too firmly against front guide plate 222. Greater angles are not needed in this case, as glossy inserts have a relatively low coefficient of friction.

Figure 5:
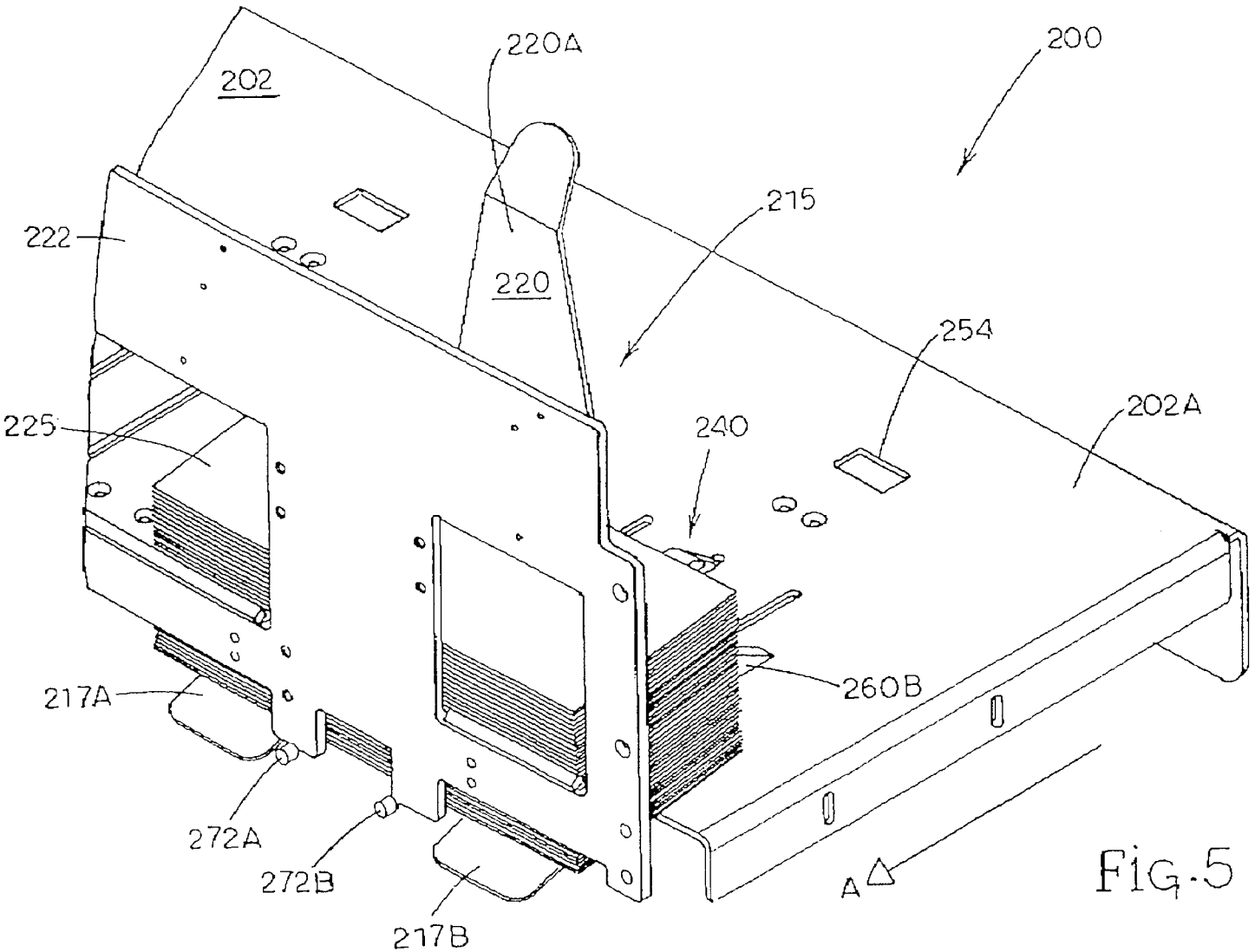
FIG. 5 is yet another perspective view of the insert hopper of FIG. 3.

FIG. 10 illustrates the influence of wedge blocks 260A and 260B on insert stack 225. Insert stack 225 is supported on a planar contact area of T-plate 230 although wedge blocks 260A and 260B have cooperated to reduce that contact area, particularly at lateral edges 230BA and 230BB (see FIG. 7) of T-plate 230. FIGS. 5 and 10 also show the use of a pair of separator screws 272A and 272B mounted at front guide plate 222 to support the leading edges of the inserts of insert stack 225 during extraction of the lowermost sheet from insert hopper 215.

Alternatively, one or more wedge blocks 260A or 260B could be mounted directly to back stop 220 and extend laterally from either vertical section 220A or base plate 220B. This configuration, however, might make it difficult to adjust wedge block 260A or 260B with respect to back stop 220 along the insert feed direction A. In addition, a single wedge block 260A or 260B having a single, angled insert support surface 262, 264, or 266 could be removably mounted to the side of back stop 220 facing the insert hopper area. In such case, other wedge blocks 260A or 260B having differently angled insert support surfaces 262, 264, or 266 could be selectively attached to back stop 220 when a different angle of inclination of insert stack 225 is needed for a particular job. Moreover, T-plate 230 could be modified to receive wedge blocks 260A and 260B for removable mounting thereon.

EXAMPLES

A mail insertion machine was set up to process 0.004×3.750×8.50 inch glossy material. The machine was initially equipped with conventional insert hoppers lacking reduced-friction T-plate 230 and wedge blocks 260A and 260B. After a number of test runs, the maximum working insert stack height was observed to be in the range of 4 to 5 inches. The insert hoppers were then modified by substituting PTFE-coated T-plate 230 for the conventional T-plate and installing wedge blocks 260A and 260B. The working stack height increased to 10 inches, the maximum physical capacity of the insert hopper, and no misfeeds were observed.

The machine was then set up to process 0.0035×3.900×6.625 inch glossy material. With conventional insert hoppers, the maximum working insert stack height was observed to be in the range of 2 to 3 inches. Again, the insert hoppers were modified by substituting PTFE-coated T-plate 230 and installing wedge blocks 260A and 260B. As a result, the working stack height again reached the maximum of 10 inches, and the operation was error-free. The latter test was repeated with improved insert hopper 215 loaded to an insert stack height of 26 inches and achieved similar success.

Finally, tests involving the processing of 0.004×3.750×7.00 non-glossy inserts and 0.002×3.750×7.250 letter fold inserts proved to be successful as well.

It thus may be seen that the present invention provides an insert hopper 215 characterized by increased insert stack loading capacity and improved registration.

It will be understood that for some types of mail processing jobs and for some types of inserts, the use of reduced-friction T-plate 230 by itself can be sufficient to meet the objects of the present invention, while in other cases the use of wedge blocks 260A and 260B with a conventional bottom support can be sufficient. In still other cases, the combination of T-plate 230 and wedge blocks 260A and 260B will be found as constituting the optimal configuration. Moreover, reduced-friction T-plate 230, wedge blocks 260A and 260B, or a combination of both, can be used in conjunction with insert hopper 215 tilted from the vertical. Each of these alternatives are considered to be aspects of the present invention.

Figure 2:
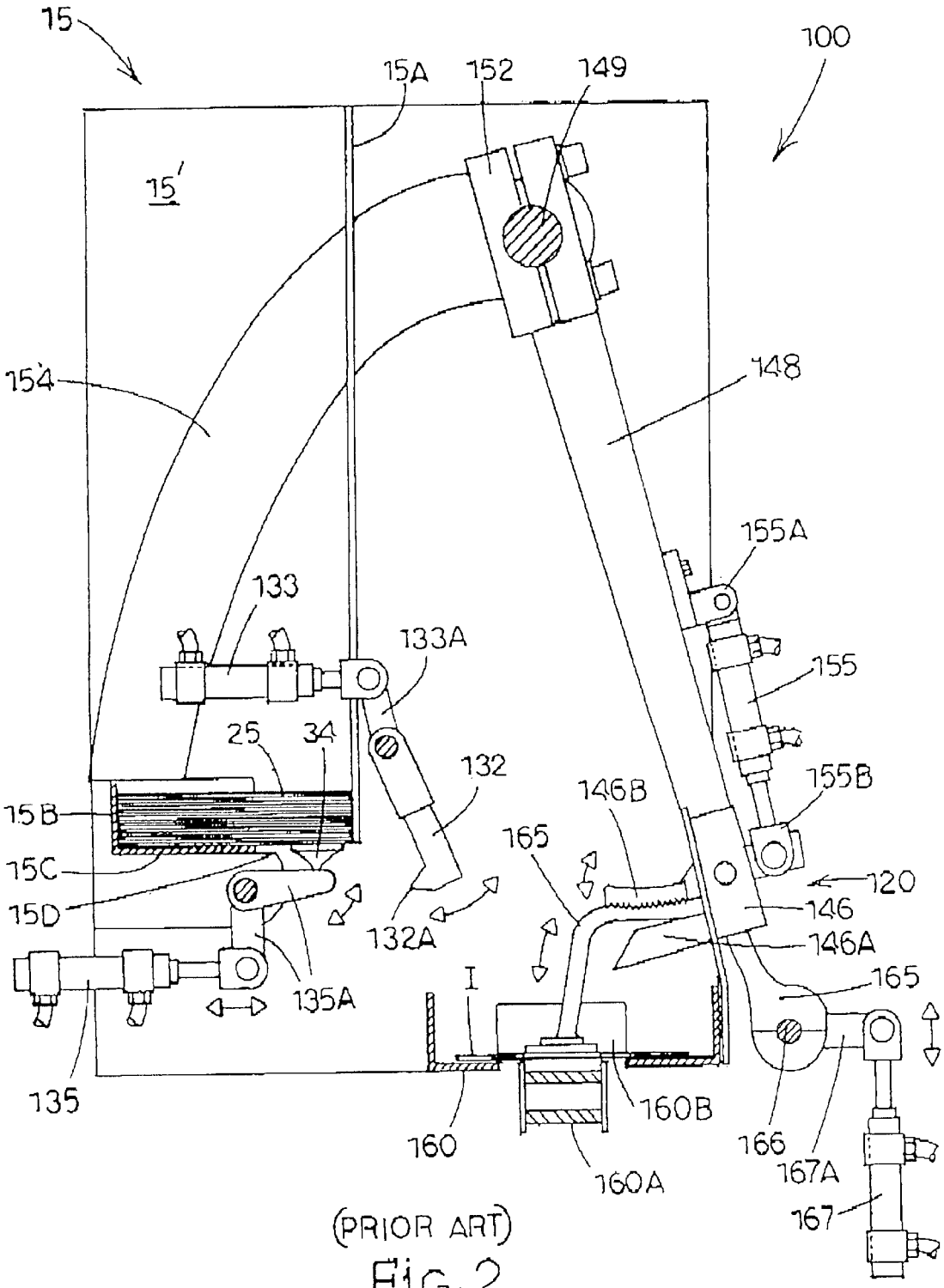
(PRIOR ART) FIG. 2
FIG. 2 is a side elevation view of another prior art insert feed station which can be used in connection with an insert hopper designed in accordance with the present invention.

It will be further understood that other insert extraction means, besides insert extraction means 20 exemplified in FIG. 1 and insert extraction means 120 exemplified in FIG. 2, are known by those skilled in the art. Such other insert extraction means are considered to be equivalent to insert extraction means 20 and 120 for purposes of the present invention and can benefit from the use of improved insert hopper 215 and associated components disclosed herein.

It will be also understood that various details of the invention may be changed without departing from the scope of the invention. Furthermore, the foregoing description is for the purpose of illustration only, and not for the purpose of limitation—the invention being defined by the claims.

What is claimed is:

1. An insert hopper for storing a stack of inserts and enabling seriatim extraction of a lowermost insert of an insert stack from a lower location of the insert hopper along an insert feed direction, comprising:

(a) a support deck defining a lower boundary of an insert hopper area in which a stack of inserts can be loaded;

(b) a front registration member for registering respective leading edges of a stack of inserts loaded in the insert hopper area, the front registration member extending upwardly in relation to the support deck and defining a front boundary of the insert hopper area;

(c) a back stop member extending upwardly in relation to the support deck and defining a rear boundary of the insert hopper area; and (d) a bottom support plate adjustably mounted on the support deck and movable in relation to the back stop member, the bottom support plate having an outer surface on which a lowermost insert of an insert stack can be disposed, wherein a front edge of the bottom support plate and the front registration member cooperatively define an insert hopper bottom opening through which a lowermost insert of an insert stack can be extracted.

2. The insert hopper according to claim 1 wherein the bottom support plate includes a longitudinal section extending along a direction generally toward the front registration member and a transverse section disposed in perpendicular relation to the longitudinal section, the transverse section including the front edge of the bottom support plate and the outer surface on which a lowermost insert of an insert stack can be disposed.

3. The insert hopper according to claim 1 further comprising a wedge block mounted on the support deck and having a front surface for supporting a trailing edge of a lowermost insert of an insert stack, the front surface extending into the insert hopper area and angled with respect to the support deck.

4. The insert hopper according to claim 1 wherein the front registration plate, the back stop member and the bottom support are tilted with respect to a vertical reference line.

5. The insert hopper according to claim 1 wherein the back stop member is spaced rearwardly with respect to the front registration member along an insert feed direction, the insert feed direction defined as a general direction from the back stop member toward the front registration member, and the bottom support plate is adjustably mounted on the support deck along a reference line parallel with the insert feed direction.

6. The insert hopper according to claim 5 wherein the bottom support plate is slidably interposed between the back stop member and the support deck.

7. The insert hopper according to claim 1 wherein the outer surface of the bottom support plate is constructed of a low-friction material exhibiting a coefficient of friction less than a coefficient of friction exhibited by a cold-rolled steel plate.

8. The insert hopper according to claim 7 wherein the coefficient of friction of the low-friction material is less than a coefficient of friction exhibited by a cold-rolled steel plate having a black oxide outer surface.

9. The insert hopper according to claim 1 wherein the wedge block includes a plurality of angled surfaces, the plurality of angled surfaces including the insert support surface, wherein each angled surface has an angle with respect to the plane different from respective angles of the other angled surfaces.

10. The insert hopper according to claim 9 wherein the wedge block is removably mounted on the support deck in a first orientation wherein the insert support surface is a first one of the plurality of angled surfaces, and the wedge block is movable to a second orientation wherein a second one of the plurality of angled surfaces becomes the insert support surface.

11. The insert hopper according to claim 1 wherein the support deck has a slot extending along a direction generally toward the front registration member, and the back stop member is slidably mounted in the slot.

12. The insert hopper according to claim 11 comprising a locking mechanism adapted for alternately locking and releasing a position of the back stop member in relation to the slot.

13. The insert hopper according to claim 1 wherein the outer surface of the bottom support plate is constructed of a low-friction material selected from the group consisting of PTFE, chrome, and finished stainless steel.

14. The insert hopper according to claim 13 wherein the outer surface of the bottom support plate is a coating.

15. The insert hopper according to claim 13 wherein the outer surface of the bottom support plate is a plating.

16. The insert hopper according to claim 1 wherein the support deck has a first slot extending along a direction generally toward the front registration member, and the bottom support plate is slidably mounted in the first slot.

17. The insert hopper according to claim 16 comprising an adjustment mechanism connected to the bottom support plate for adjusting a position of the bottom support plate with respect to the first slot.

18. The insert hopper according to claim 17 wherein the adjustment mechanism comprises a first slide block movable along the first slot.

19. The insert hopper according to claim 16 wherein the support deck has a second slot extending in generally parallel relation to the first slot, and a portion of the back stop member is movably guided in the second slot.

20. The insert hopper according to claim 19 comprising a locking mechanism adapted for alternately locking and releasing a position of the back stop member in relation to the second slot.

21. An insert hopper for storing a stack of inserts and enabling seriatim extraction of a lowermost insert of an insert stack from a lower location of the insert hopper along an insert feed direction, comprising:

(a) a support deck disposed in a plane and defining a lower boundary of an insert hopper area in which a stack of inserts can be loaded;

(b) a front registration member for registering respective leading edges of a stack of inserts loaded in the insert hopper area, the front registration member extending upwardly in relation to the support deck and defining a front boundary of the insert hopper area, and further defining an insert hopper bottom opening through which a lowermost insert of an insert stack can be extracted;

(c) a back stop member extending upwardly in relation to the support deck and defining a rear boundary of the insert hopper area; and (d) a wedge block mounted on the support deck and comprising a plurality of differently angled surfaces for supporting the lowermost insert, wherein the wedge block is movable to a first orientation at which a first one of the angled surfaces extends into the insert hopper area, and to a second orientation at which a second one of the angled surfaces extends into the insert hopper area.

22. The insert hopper according to claim 21 wherein a first one of the plurality of angled surfaces has an angle of 45° with respect to the plane.

23. The insert hopper according to claim 21 wherein a first one of the plurality of angled surfaces has an angle of 30° with respect to the plane.

24. The insert hopper according to claim 21 wherein a first one of the plurality of angled surfaces has an angle of 60° with respect to the plane.

25. The insert hopper according to claim 21 further wherein the back stop member has a front side facing the insert hopper area and the wedge block is mounted to the front side.

26. The insert hopper according to claim 21 further comprising first and second wedge blocks mounted on the support deck, the first wedge block disposed adjacent to a first lateral edge of the back stop member and having a first insert support surface, and the second wedge block disposed adjacent to a second lateral edge of the back stop member and having a second insert support surface.

27. The insert hopper according to claim 21 wherein the wedge block is adjustable with respect to the back stop member.

28. The insert hopper according to claim 27 wherein the wedge block has a plurality of bores drilled therethrough, each bore spaced from an adjacent one of the plurality of bores, the insert hopper further comprising an elongate member extending through one of the plurality of bores, whereby the magnitude by which the insert support surface extends into the insert hopper area depends on the bore through which the elongate member extends.

29. The insert hopper according to claim 21 wherein the back stop member is adjustable along a direction generally toward the front registration member.

30. The insert hopper according to claim 29 wherein the wedge block mechanically communicates with the back stop member through a structural member, whereby adjustment of the back stop member causes adjustment of the wedge block.

31. The insert hopper according to claim 21 further comprising a bottom support plate having a front edge and mounted on the support deck, wherein the front edge and the front registration member cooperatively define the insert hopper bottom opening.

32. The insert hopper according to claim 31 wherein the wedge block is mounted to the bottom support plate.

33. The insert hopper according to claim 21 wherein the front registration plate and the back stop member are tilted with respect to a vertical reference line.

34. The insert hopper according to claim 33 wherein the wedge block includes a base tilted with respect to the vertical reference line.

35. The insert hopper according to claim 21 wherein the wedge block is adjustably disposed on the support deck and movable along a direction generally toward the front registration member.

36. The insert hopper according to claim 35 wherein the support deck has a first slot and the wedge block is slidably mounted in the first slot.

37. The insert hopper according to claim 36 comprising a locking mechanism adapted for alternately locking and releasing a position of the wedge block in relation to the first slot.

38. The insert hopper according to claim 36 comprising a bottom support plate adjustably mounted on the support deck, wherein the support deck has a second slot and the bottom support plate is guided in the second slot.

39. The insert hopper according to claim 36 wherein the wedge block is slidably mounted in the first slot through connection of the wedge block to the back stop member.

40. The insert hopper according to claim 39 wherein the wedge block is adjustably connected to the back stop member to enable a position of the insert support surface with respect to the back stop member to be adjusted.

41. A mail insertion machine comprising:

(a) an insert hopper comprising:

(i) a support deck defining a lower boundary of an insert hopper area in which a stack of inserts can be loaded;

(ii) a front registration member for registering respective leading edges of a stack of inserts which can be loaded in the insert hopper area, the front registration member extending upwardly in relation to the support deck and defining a front boundary of the insert hopper area;

(iii) a back stop member extending upwardly in relation to the support deck and defining a rear boundary of the insert hopper area; and (iv) a bottom support plate adjustably mounted on the support deck and movable in relation to the back stop member, the bottom support plate having an outer surface on which a lowermost insert of an insert stack can be disposed, wherein a front edge of the bottom support plate and the front registration member cooperatively define an insert hopper bottom opening through which a lowermost insert of an insert stack can be extracted; and (b) an insert extraction device adapted to cyclically move into engagement with a lowermost insert of an insert stack which can be loaded in the insert hopper area and which is adapted to extract such a lowermost insert from the insert hopper.

42. The mail insertion machine according to claim 41 further comprising a suction device mounted to a suction device actuating member and including an orifice communicating with a vacuum source, the suction device actuating member adapted to cyclically move the suction device into the lower insert hopper opening and into contact with a lowermost insert of an insert stack which can be loaded in the insert hopper area and to separate such a lowermost insert from such an insert stack.

43. The mail insertion machine according to claim 41 wherein the outer surface of the bottom support plate is constructed of a low-friction material selected from the group consisting of PTFE, chrome, and finished stainless steel.

44. The mail insertion machine according to claim 41 wherein the outer surface of the bottom support plate is constructed of a low-friction material exhibiting a coefficient of friction less than a coefficient of friction exhibited by a cold-rolled steel plate.

45. The insert hopper according to claim 44 wherein the coefficient of friction of the low-friction material is less than a coefficient of friction exhibited by a cold-rolled steel plate having a black oxide outer surface.

46. A mail insertion machine comprising:

(a) an insert hopper comprising:

(i) a support deck disposed in a plane and defining a lower boundary of an insert hopper area in which a stack of inserts can be loaded;

(ii) a front registration member for registering respective leading edges of a stack of inserts loaded in the insert hopper area, the front registration member extending upwardly in relation to the support deck and defining a front boundary of the insert hopper area, and further defining an insert hopper bottom opening through which a lowermost insert of the insert stack can be extracted;

(iii) a back stop member extending upwardly in relation to the support deck and defining a rear boundary of the insert hopper area; and (iv) a wedge block mounted on the support deck and comprising a plurality of differently angled surfaces for supporting the lowermost insert, wherein the wedge block is movable to a first orientation at which a first one of the angled surfaces extends into the insert hopper area, and to a second orientation at which a second one of the angled surfaces extends into the insert hopper area; and (b) an insert extraction device adapted to cyclically move into engagement with the lowermost insert and extract the lowermost insert from the insert hopper.

47. The mail insertion machine according to claim 46 further comprising a suction device mounted to a suction device actuating member and including an orifice communicating with a vacuum source, the suction device actuating member adapted to cyclically move the suction device into the lower insert hopper opening and into contact with the lowermost insert and to separate the lowermost insert from the insert stack.

48. A method for increasing the capacity of an insert hopper to hold and register a stack of inserts loaded into the insert hopper for subsequent improved extraction from the insert hopper, the method comprising:

(a) constructing an insert hopper by:

(i) disposing a support deck in a plane to define a lower boundary of an insert hopper area in which a stack of inserts can be loaded;

(ii) providing a front registration member for registering respective leading edges of a stack of inserts loaded in the insert hopper area, the front registration member extending substantially upwardly in relation to the support deck to define a front boundary of the insert hopper area and define an insert hopper bottom opening through which a lowermost insert of such an insert stack can be extracted; and (iii) providing a back stop member extending upwardly in relation to the support deck to define a rear boundary of the insert hopper area, and spacing the back stop member rearwardly with respect to the front registration member; and (b) providing a wedge block having a plurality of wedge block surfaces, wherein each wedge block surface is differently angled with respect to the plane;

(c) selecting one of the wedge block surfaces to serve as an insert support surface; and (d) mounting the wedge block on the support deck whereby the selected wedge block surface extends into the insert hopper area to support a trailing edge of a lowermost insert of an insert stack.

49. The method according to claim 48 further comprising the step of mounting the insert hopper in a tilted orientation with respect to a vertical reference line.

50. An insert hopper comprising:

(a) a support deck defining a lower boundary of an insert hopper area in which a stack of inserts can be loaded;

(b) a front registration member for registering respective leading edges of a stack of inserts loaded in the insert hopper area, the front registration member extending upwardly in relation to the support deck and defining a front boundary of the insert hopper area;

(c) a back stop member extending upwardly in relation to the support deck and defining a rear boundary of the insert hopper area, the back stop member spaced rearwardly with respect to the front registration member along an insert feed direction, the insert feed direction defined as a general direction from the back stop member toward the front registration member; and (d) a bottom support plate having a front edge and adjustably interposed between the back stop member and the support deck, the bottom support plate having an outer surface on which a lowermost insert of an insert stack can be disposed, the outer surface constructed of a low-friction material selected from the group consisting of PTFE, chrome, and finished stainless steel, wherein the front edge and the front registration member cooperatively define an insert hopper bottom opening through which a lowermost insert of an insert stack can be extracted.

51. The insert hopper according to claim 50 wherein the support deck has a slot, the bottom support plate is mounted to a slide block disposed below the slot, and the bottom support plate and slide block are movable forwardly and rearwardly along the slot.

52. An insert hopper comprising:

(a) a support deck disposed in a plane and defining a lower boundary of an insert hopper area in which a stack of inserts can be loaded;

(b) a front registration member for registering respective leading edges of a stack of inserts loaded in the insert hopper area, the front registration member extending upwardly in relation to the support deck and defining a front boundary of the insert hopper area, and further defining an insert hopper bottom opening through which a lowermost insert of an insert stack can be extracted;

(c) a back stop member extending upwardly in relation to the support deck and defining a rear boundary of the insert hopper area, the back stop member spaced rearwardly with respect to the front registration member along an insert feed direction, the insert feed direction defined as a general direction from the back stop member toward the front registration member; and (d) a wedge block mounted on the support deck and adjustable in relation to the back stop member, the wedge block having an insert support surface supporting a trailing edge of the lowermost insert, the insert support surface extending into the insert hopper area and angled with respect to the plane.

53. The insert hopper according to claim 52 wherein the wedge block has a plurality of bores drilled therethrough, each bore spaced from an adjacent one of the plurality of bores, the insert hopper further comprising an elongate member extending through one of the plurality of bores, whereby the magnitude by which the insert support surface extends into the insert hopper area depends on the bore through which the elongate member extends.

54. A method for increasing the capacity of an insert hopper to hold and register a stack of inserts loaded into the insert hopper for subsequent improved extraction from the insert hopper, the method comprising:

(a) constructing an insert hopper by:

(i) providing a support deck to define a lower boundary of an insert hopper area in which a stack of inserts can be loaded;

(ii) providing a front registration member for registering respective leading edges of a stack of inserts loaded in the insert hopper area, the front registration member extending upwardly in relation to the support deck to define a front boundary of the insert hopper area;

(iii) providing a back stop member extending upwardly in relation to the support deck to define a rear boundary of the insert hopper area, and spacing the back stop member rearwardly with respect to the front registration member along an insert feed direction, the insert feed direction defined as a general direction from the back stop member toward the front registration member; and (b) adjustably mounting a bottom support plate on the support deck, whereby the bottom support plate is movable in relation to the back stop member, a lowermost insert of the insert stack is disposed on an outer surface of the bottom support plate, and a front edge of the bottom support plate cooperates with the front registration member to define an insert hopper bottom opening through which the lowermost insert can be extracted from the insert hopper.

55. The method according to claim 54 further comprising the step of mounting the insert hopper in a tilted orientation with respect to a vertical reference line.

56. The method according to claim 54 comprising the step of reducing the friction of a bottom support plate by providing the outer surface of the bottom support plate with a low-friction material selected from the group consisting of PTFE, chrome, and finished stainless steel.

57. The method according to claim 54 comprising the step of reducing the friction of the bottom support plate by providing the outer surface of the bottom support plate with a low-friction material, wherein the low-friction material exhibits a coefficient of friction less than a coefficient of friction exhibited by a cold-rolled steel plate.

58. The method according to claim 57 wherein the outer surface provided is constructed of a low-friction material exhibiting a coefficient of friction less than a coefficient of friction exhibited by a cold-rolled steel plate having a black oxide outer surface.

59. The method according to claim 57 further comprising the step of mounting the insert hopper in a tilted orientation with respect to a vertical reference line.

60. An insert hopper for storing a stack of inserts and enabling seriatim extraction of a lowermost insert of an insert stack from a lower location of the insert hopper along an insert feed direction, comprising:

(a) a support deck disposed in a plane and defining a lower boundary of an insert hopper area in which a stack of inserts can be loaded, the support deck having a first slot;

(b) a front registration member for registering respective leading edges of a stack of inserts loaded in the insert hopper area, the front registration member extending upwardly in relation to the support deck and defining a front boundary of the insert hopper area, and further defining an insert hopper bottom opening through which a lowermost insert of an insert stack can be extracted;

(c) a back stop member extending upwardly in relation to the support deck and defining a rear boundary of the insert hopper area; and (d) a wedge block slidably mounted in the first slot and movable along a direction generally toward the front registration member, the wedge block having an insert support surface supporting a trailing edge of the lowermost insert, the insert support surface extending into the insert hopper area and angled with respect to the plane.

61. The insert hopper according to claim 60 comprising a locking mechanism adapted for alternately locking and releasing a position of the wedge block in relation to the first slot.

62. The insert hopper according to claim 60 comprising a bottom support plate adjustably mounted on the support deck, wherein the support deck has a second slot and the bottom support plate is guided in the second slot.

63. The insert hopper according to claim 60 wherein the wedge block is slidably mounted in the first slot through connection of the wedge block to the back stop member.

64. The insert hopper according to claim 63 wherein the wedge block is adjustably connected to the back stop member to enable a position of the insert support surface with respect to the back stop member to be adjusted.

65. An insert hopper comprising:

(a) a support deck disposed in a plane and defining a lower boundary of an insert hopper area in which a stack of inserts can be loaded;

(b) a front registration member for registering respective leading edges of a stack of inserts loaded in the insert hopper area, the front registration member extending upwardly in relation to the support deck and defining a front boundary of the insert hopper area, and further defining an insert hopper bottom opening through which a lowermost insert of an insert stack can be extracted;

(c) a back stop member extending upwardly in relation to the support deck and defining a rear boundary of the insert hopper area, the back stop member spaced rearwardly with respect to the front registration member along an insert feed direction, the insert feed direction defined as a general direction from the back stop member toward the front registration member;

(d) a bottom support plate having a front edge and mounted on the support deck, wherein the front edge and the front registration member cooperatively define the insert hopper bottom opening; and (e) a wedge block mounted on the bottom support plate and having an insert support surface supporting a trailing edge of the lowermost insert, the insert support surface extending into the insert hopper area and angled with respect to the plane.

66. An insert hopper comprising:

(a) a support deck disposed in a plane and defining a lower boundary of an insert hopper area in which a stack of inserts can be loaded;

(b) a front registration member for registering respective leading edges of a stack of inserts loaded in the insert hopper area, the front registration member extending upwardly in relation to the support deck and defining a front boundary of the insert hopper area, and further defining an insert hopper bottom opening through which a lowermost insert of an insert stack can be extracted;

(c) a back stop member extending upwardly in relation to the support deck and defining a rear boundary of the insert hopper area;

(d) a bottom support plate adjustably interposed between the back stop member and the support deck; and (e) a wedge block mounted on the support deck adjacent to the back stop member and having an insert support surface supporting a trailing edge of the lowermost insert, the insert support surface extending into the insert hopper area and angled with respect to the plane.

67. An insert hopper comprising:

(a) a support deck disposed in a plane and defining a lower boundary of an insert hopper area in which a stack of inserts can be loaded;

(b) a front registration member for registering respective leading edges of a stack of inserts loaded in the insert hopper area, the front registration member extending upwardly in relation to the support deck and defining a front boundary of the insert hopper area, and further defining an insert hopper bottom opening through which a lowermost insert of an insert stack can be extracted;

(c) a back stop member extending upwardly in relation to the support deck and defining a rear boundary of the insert hopper area; and (d) a wedge block mounted on the support deck and movable in relation to the back stop member.

68. An insert hopper for storing a stack of inserts and enabling seriatim extraction of a lowermost insert of an insert stack from a lower location of the insert hopper along an insert feed direction, comprising:

(a) a support deck disposed in a plane and defining a lower boundary of an insert hopper area in which a stack of inserts can be loaded;

(b) a front registration member for registering respective leading edges of a stack of inserts loaded in the insert hopper area, the front registration member extending upwardly in relation to the support deck and defining a front boundary of the insert hopper area, and further defining an insert hopper bottom opening through which a lowermost insert of an insert stack can be extracted;

(c) a back stop member extending upwardly in relation to the support deck and defining a rear boundary of the insert hopper area;

(d) a wedge block mounted on the support deck and having an insert support surface supporting a trailing edge of the lowermost insert, the insert support surface extending into the insert hopper area and angled with respect to the plane, and further having a plurality of bores drilled therethrough, each bore spaced from an adjacent one of the plurality of bores; and (e) an elongate member extending through one of the plurality of bores, whereby the magnitude by which the insert support surface extends into the insert hopper area depends on the bore through which the elongate member extends.

* * * * *